US009625116B2

(12) United States Patent
Hsu

(10) Patent No.: US 9,625,116 B2
(45) Date of Patent: Apr. 18, 2017

(54) HEADLIGHT SYSTEM

(71) Applicant: Chen-Wei Hsu, Tainan (TW)

(72) Inventor: Chen-Wei Hsu, Tainan (TW)

( * ) Notice: Subject to any disclaimer, the term of this patent is extended or adjusted under 35 U.S.C. 154(b) by 0 days.

(21) Appl. No.: 14/726,617

(22) Filed: Jun. 1, 2015

(65) Prior Publication Data

US 2016/0348868 A1 Dec. 1, 2016

(51) Int. Cl.

| | |
|---|---|
| ***F21V 5/00*** | (2015.01) |
| ***F21S 8/10*** | (2006.01) |
| ***F21Y 101/00*** | (2016.01) |
| *F21Y 101/02* | (2006.01) |

(52) U.S. Cl.

CPC ..... *F21S 48/328* (2013.01); *F21S 48/115* (2013.01); *F21S 48/125* (2013.01); *F21S 48/325* (2013.01); *F21Y 2101/02* (2013.01)

(58) Field of Classification Search

CPC ..... F21S 48/125; F21S 48/115; F21S 48/328; F21S 48/325; F21S 48/321; F21S 48/1275

USPC ..... 362/520

See application file for complete search history.

(56) References Cited

U.S. PATENT DOCUMENTS

| | | | | |
|---|---|---|---|---|
| 2010/0165652 | A1* | 7/2010 | Ookubo | F21S 48/1154 362/522 |
| 2012/0106167 | A1* | 5/2012 | Chang | F21V 5/045 362/311.02 |
| 2013/0027961 | A1* | 1/2013 | Ugajin | F21S 48/1154 362/538 |
| 2015/0224915 | A1* | 8/2015 | Sazuka | B60Q 1/0088 362/516 |
| 2015/0252995 | A1* | 9/2015 | Jestel | F21V 29/677 362/249.01 |
| 2015/0354776 | A1* | 12/2015 | Lai | F21S 48/1113 362/487 |

* cited by examiner

*Primary Examiner* — Peggy Neils
*Assistant Examiner* — William N Harris

(57) ABSTRACT

A headlight system includes a seat, a radiator, a mounting ring, a circuit board and a lens unit. A cooling device is connected to the back of the seat and includes a housing, a fan and an external cover. The housing has a receiving area in which the fan is located. The housing defines multiple first ventilation holes which communicate with the receiving area. The external cover is connected to the housing to seal the receiving area of the housing and has multiple second ventilation holes being opposite to the first ventilation holes of the housing. The fan sends out an air current to the radiator via the ventilation holes to quickly cool down the radiator.

2 Claims, 9 Drawing Sheets

HEADLIGHT SYSTEM

BACKGROUND OF THE INVENTION

1. Fields of the Invention

The present invention relates to a headlight system, and more particularly, to a headlight system that includes a radiator and a cooling device to speed up thermal dissipation.

2. Descriptions of Related Art

A conventional headlight 1 is disclosed in FIGS. 1 and 2, and generally comprises a body 10 having a curved reflection surface 101 and defining a room 100. A light source 11, such as a Tungsten filament, a Xenon lamp or a Light Emitting Diode (LED), is located in the room 100. A separation board 12 is located at the front end of the body 10 and has a hole 120. A connection member 13 is connected to the front end of the body 10 and has a barrier unit 14 located in the connection member 13. The barrier unit 14 has a solenoid valve 140 and a barrier board 141. A lens 15 is connected to the connection member 13 by a frame 16. The light emitted from the light source 11 is reflected by the reflection surface 101 and passes through the lens 15. The barrier unit 14 controls the range and angle of the light beams so as to form the high beam and the low beam. However, the light projected by the reflection surface 101 is scattered and inadequate in brightness. Furthermore, the conventional headlight does not have a radiator so that the heat generated from the light source 11 is trapped within the room 100 of the body 10, and the heat may quickly damage the light source and other related parts.

SUMMARY OF THE INVENTION

The present invention relates to a headlight system and comprises a seat having a first side and a second side, a radiator having a front portion and a rear portion, and a cooling device, wherein the radiator is mounted to the first side of the seat and has multiple radiating fins extending from an outer periphery of the rear portion thereof. A mounting ring is mounted to the radiator, and a circuit board is connected to an end surface of the front portion of the radiator and the mounting ring. The circuit board has at least two Light Emitting Diodes (LEDs), and a lens unit is connected to the radiator and the mounting ring. The lens unit defines a space for accommodating the circuit board. The lens unit has a high-beam area and a low-beam area. At least one LED is located corresponding to the high-beam area, and at least one LED is located corresponding to the low-beam area.

The cooling device is connected to the second side of the seat and includes a housing, a fan, and an external cover. The housing defines therein a receiving area. The fan is located in the receiving area. Multiple first ventilation holes are defined at the housing and communicate with the receiving area. The external cover is connected to the housing to seal the receiving area of the housing and has multiple second ventilation holes being opposite to the first ventilation holes of the housing.

Preferably, a tubular portion extends from the second side of the seat and has a room defined therein. A protrusion extends radially from the inner periphery of the room. The housing of the cooling device has a tubular member extending from a portion thereof where the first ventilation holes are located. The tubular member is inserted in the room of the tubular portion of the seat. The tubular member defines a first indentation and a second indentation at its outer surface. The second indentation is adjacent to and at a right angle to the first indentation and extends to the distal end of the tubular member. A raised division strip is located between the first and second indentations. The protrusion is engaged with the first indentation via the second indentation to connect the tubular portion and the tubular member.

Preferably, the tubular member of the housing of the cooling device has a seal ring mounted thereto.

Preferably, the housing of the cooling device has multiple threaded holes defined therein. The external cover has multiple holes which are located corresponding to the threaded holes of the housing. Multiple bolts are inserted through the holes of the external cover and are threadedly connected to the threaded holes of the housing.

One feature of the present invention is that the headlight system includes a cooling device located at a predetermined distance away from the radiating fins. The cooling device includes a housing, a fan and an external cover. The fan sends out an air current via the ventilation holes to quickly cool down the radiator.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
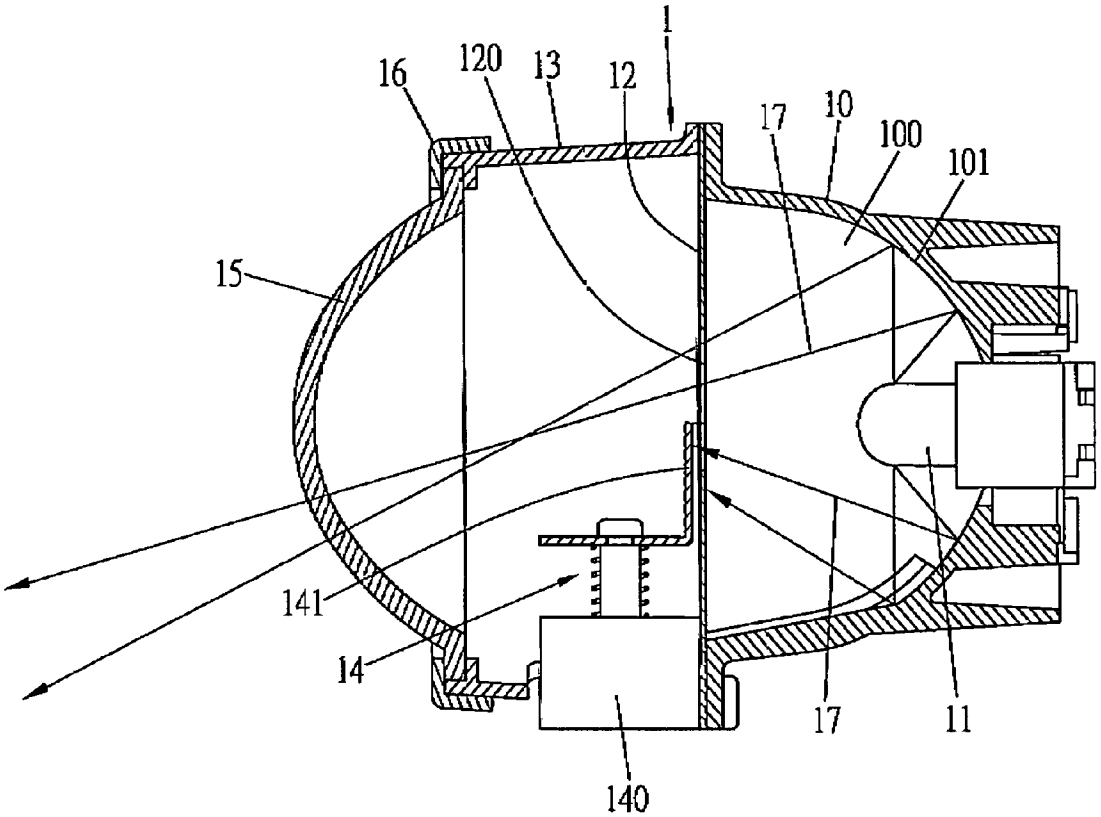
FIG.1 (PRIOR ART)
FIG. 1 shows that a conventional headlight using the low beam.
Figure 2:
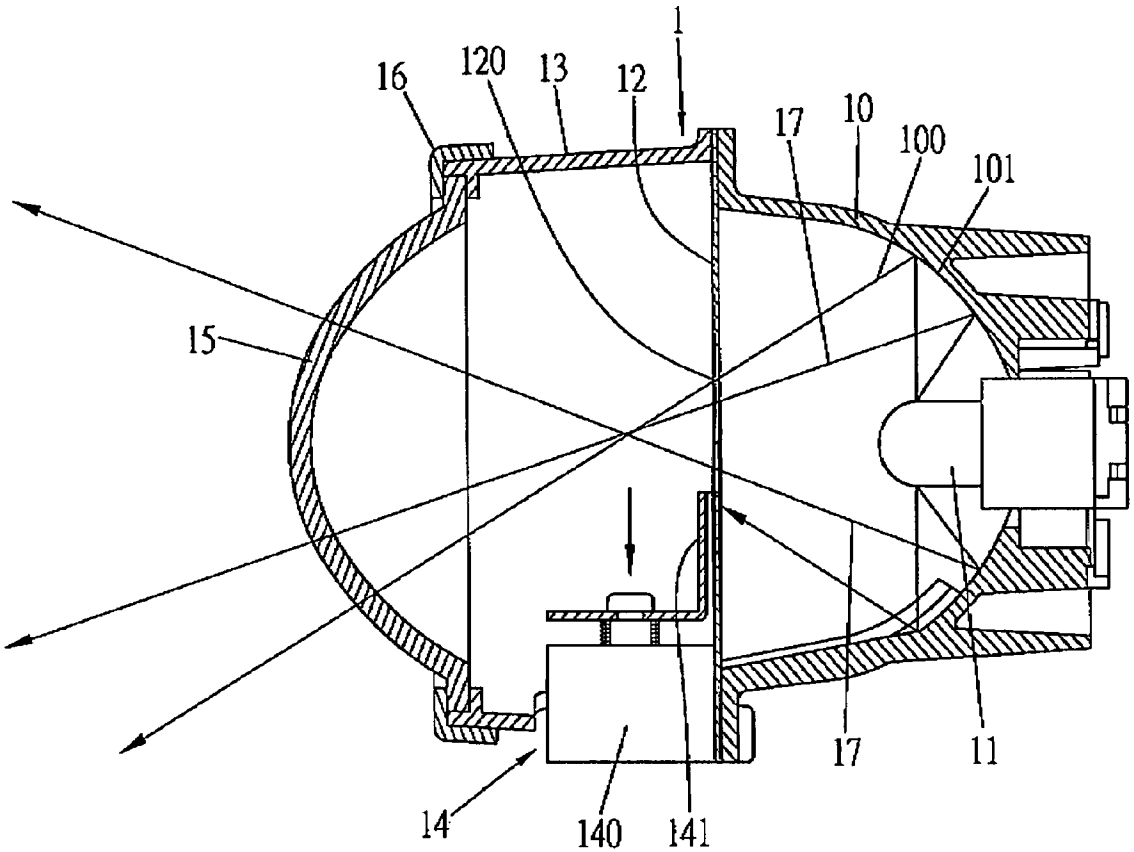
FIG.2 (PRIOR ART)
FIG. 2 shows that a conventional headlight using the high beam.
Figure 3:
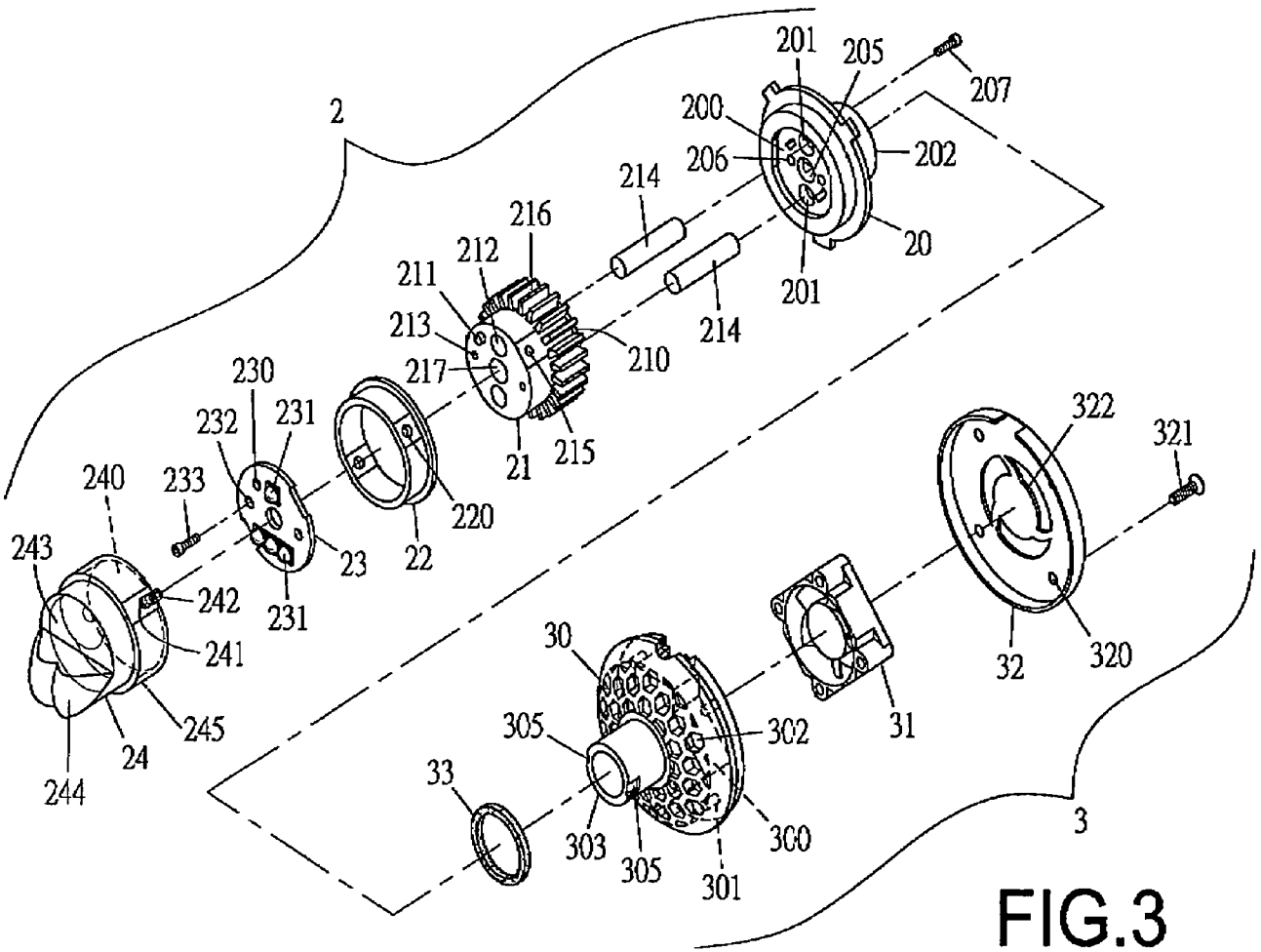
FIG. 3 is an exploded view of a headlight system according to one embodiment of the present invention.
Figure 4:
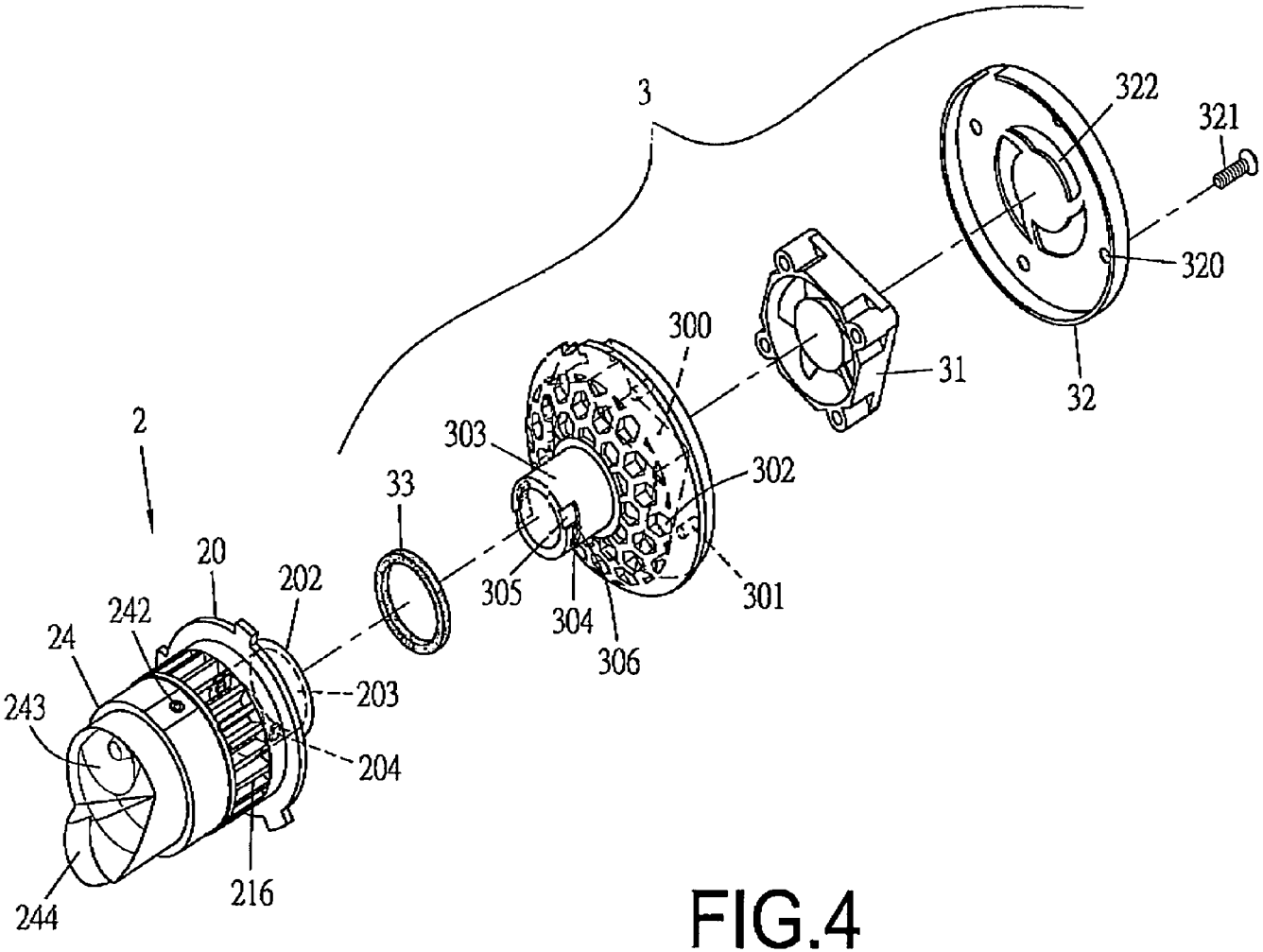
FIG. 4 is a partially exploded view of the headlight system of the present invention.
Figure 5:
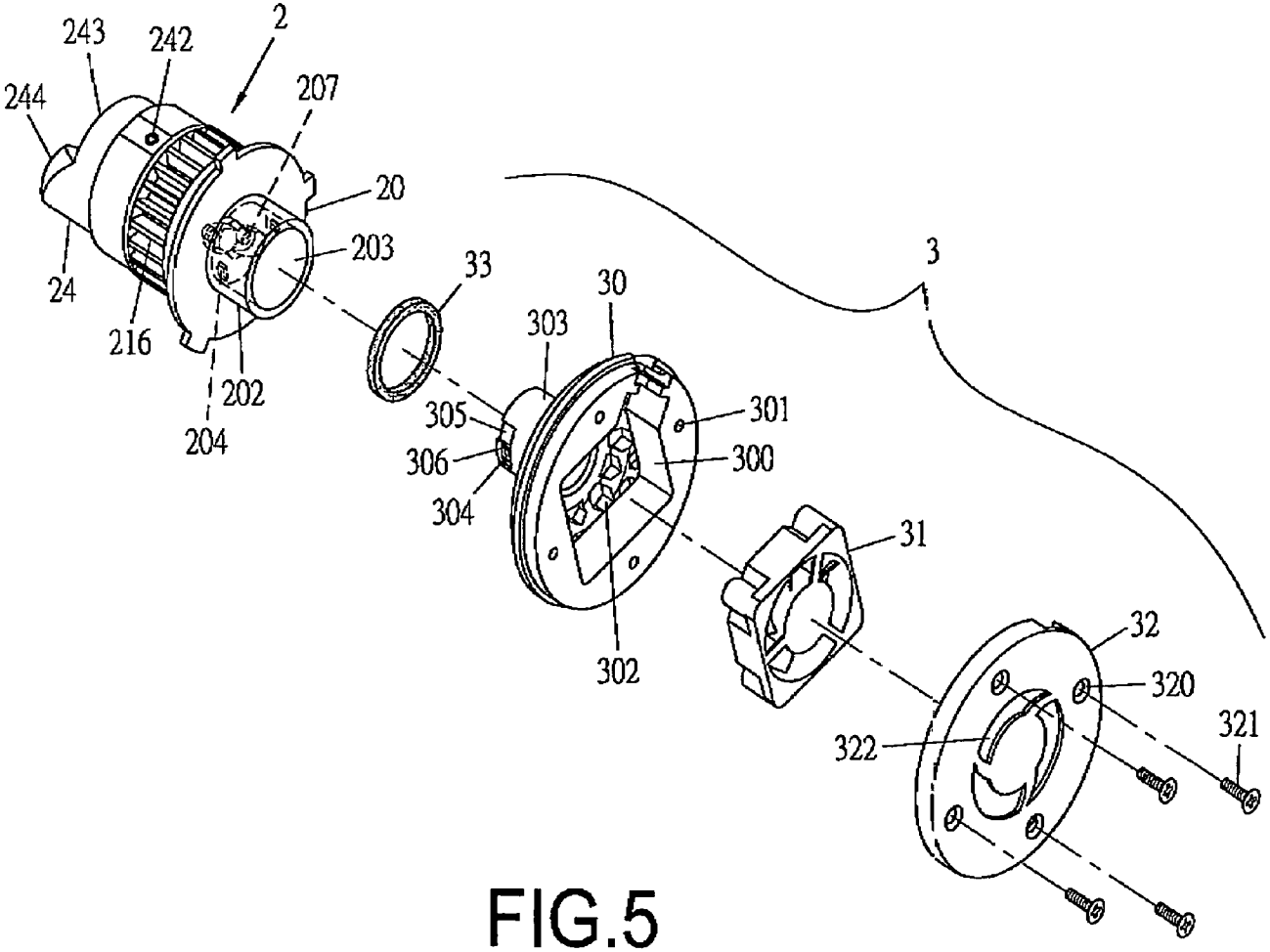
FIG. 5 is another partially exploded view of the headlight system of the present invention.
Figure 6:
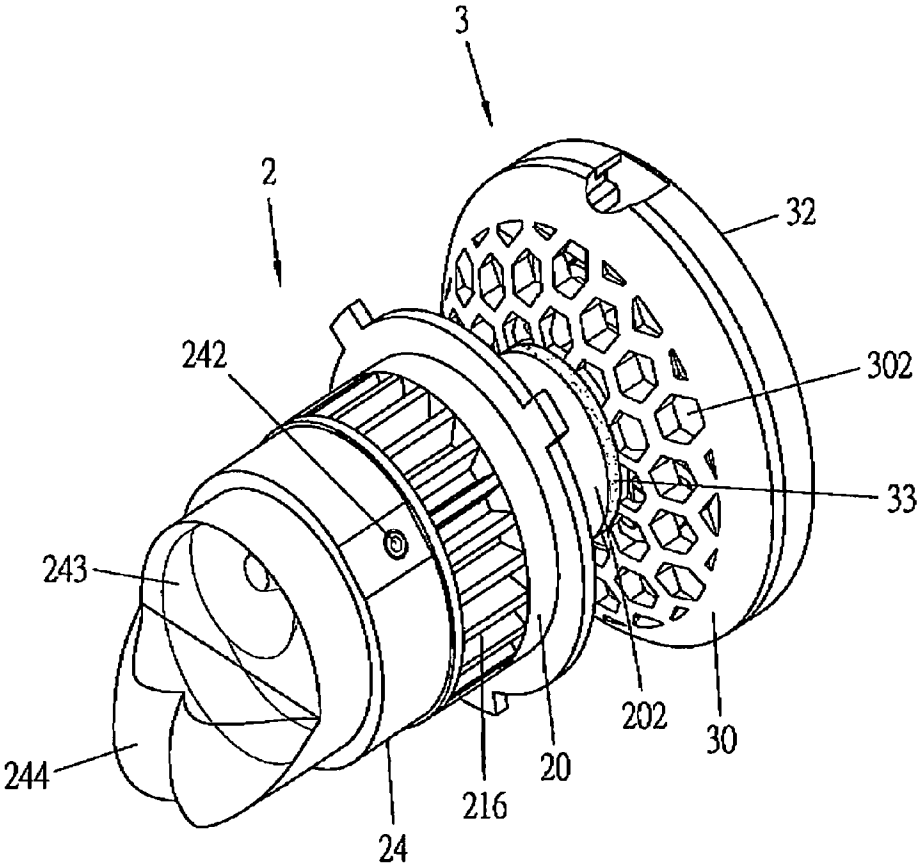
FIG. 6 is a perspective view of the headlight system of the present invention.
Figure 7:
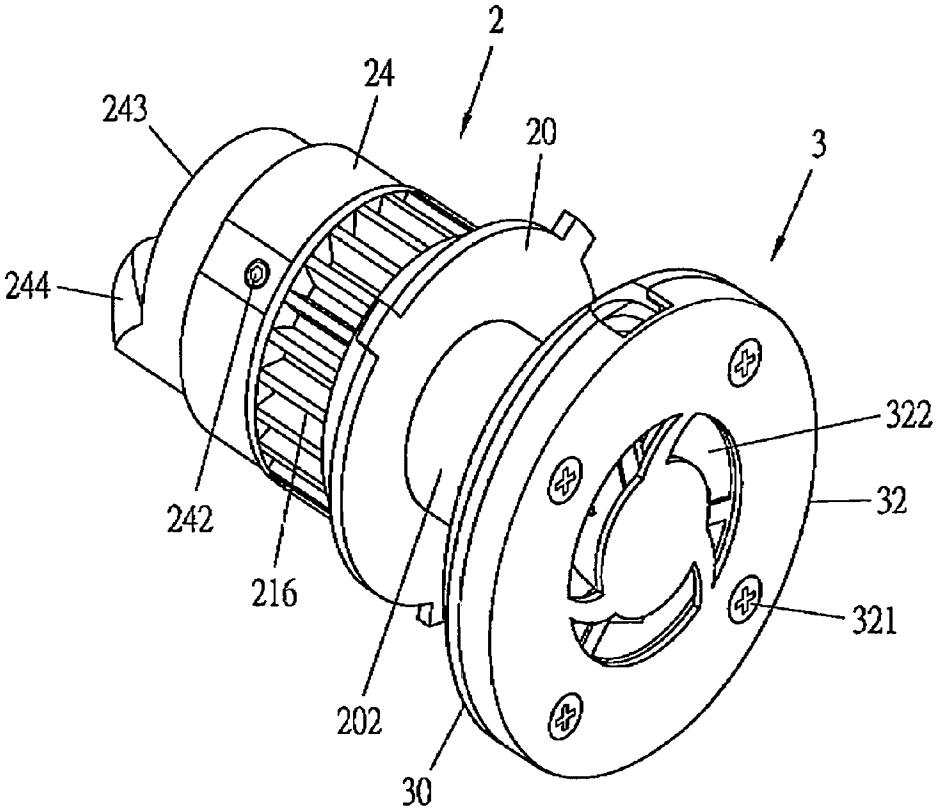
FIG. 7 is another perspective view of the headlight system of the present invention.

Referring to FIGS. 3 to 5, a headlight system according to one embodiment of the present invention is shown, which generally comprises a main assembly 2 and a cooling device 3, wherein the main assembly 2 includes a seat 20 having a first side and a second side. The seat 20 has a recessed area 200 defined at the first side thereof. Two positioning holes 201 and two holes 206 are defined at the inner surface of the recessed area 200. A tubular portion 202 extends from the second side of the seat 20 and has a room 203 defined therein. A protrusion 204 extends radially from the inner periphery of the room 203. A central through hole 205 is defined through the seat 20. Two bolts 207 are inserted through the holes 206.

Figure 8:
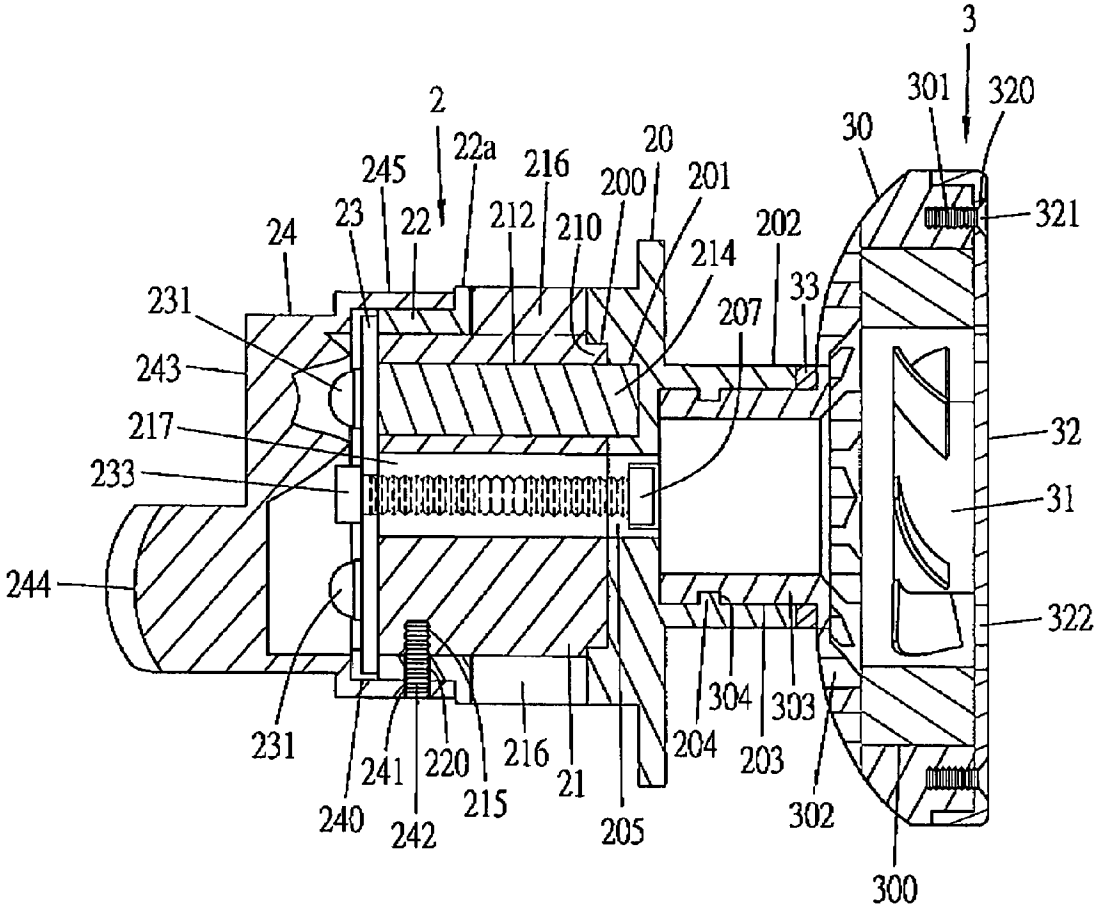
FIG. 8 is a cross sectional view of the headlight system of the present invention.
Figure 9:
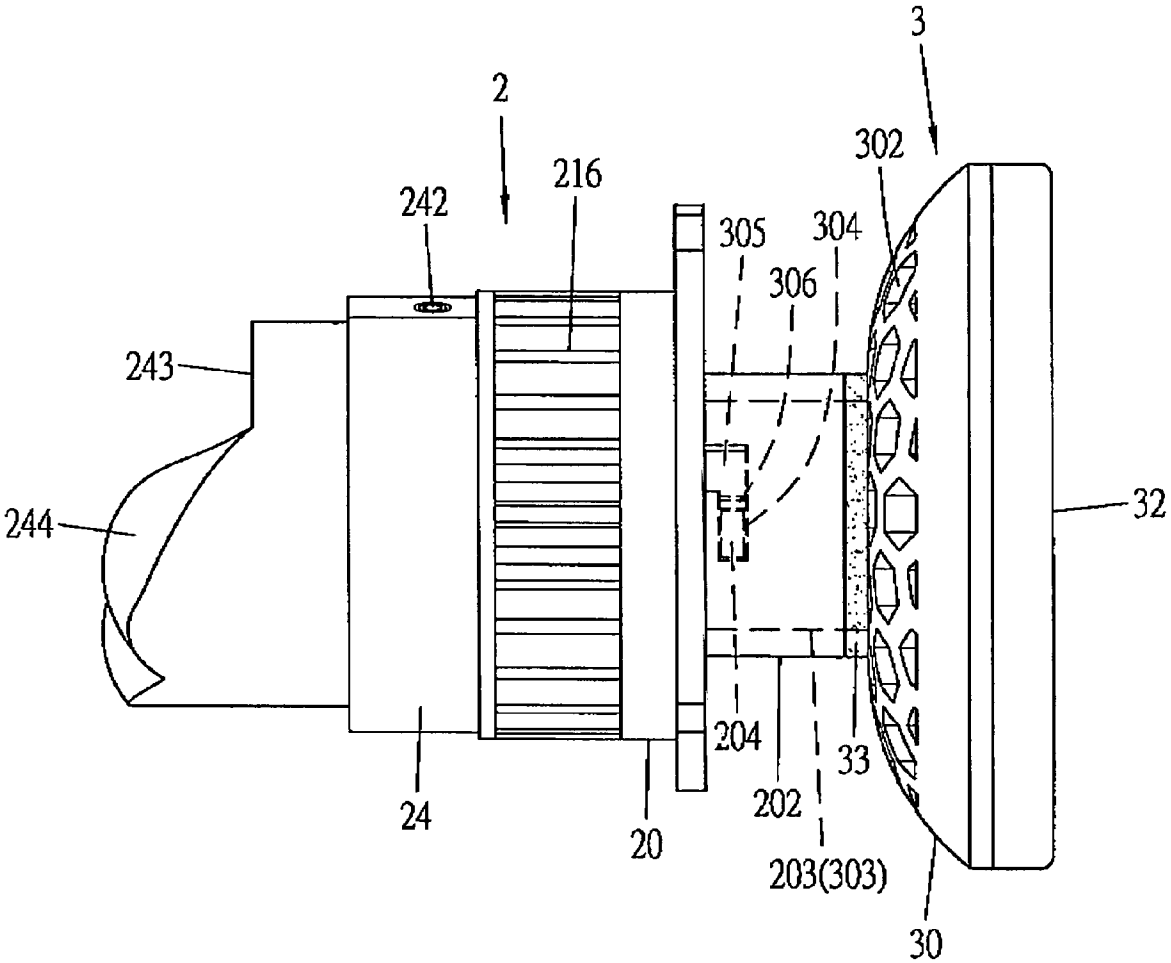
FIG. 9 shows a schematic plan view of the headlight system of the present invention, wherein a mechanism for connecting a cooling device to a seat is revealed.

A radiator 21 has a front portion and a rear portion, wherein a positioning rod 211 is provided at an end surface of the front portion of the radiator 21. Two passages 212, a central through hole 217, and two threaded holes 213 are defined in the radiator 21. The radiator 21 has a positioning portion 210 extending from its rear portion, wherein the positioning portion 210 can be inserted into the recessed area 200 of the seat 20. Two columns 214 are fitted into the passages 212. Two threaded holes 215 are defined at a periphery of the front portion of the radiator 21, and located close to the end surface of the front portion of the radiator 21. The radiator 21 has multiple radiating fins 216 extending from the outer periphery of the rear portion thereof. A mounting ring 22 with a bottom flange 22*a* (see FIG. 8) is mounted to the front portion of the radiator 21 and has two side holes 220 which are located corresponding to the threaded holes 215 of the radiator 21. A circuit board 23 is mounted on the end surface of the front portion of the radiator 21 and the mounting ring 22. The circuit board 23 has a hole 230 which is located corresponding to the positioning rod 211 on the radiator 21. At least two Light Emitting Diodes (LEDs) are provided at the circuit board 23. The circuit board 23 has two holes 232 which are located corresponding to the threaded holes 213 of the radiator 21. Two bolts 233 are inserted through the holes 232 of the circuit board 23 and are connected to the threaded holes 213 of the radiator 21 so as to connect the circuit board 23 and the radiator 21.

A lens unit 24 is mounted over the radiator 21 and the mounting ring 22. The lens unit 24 has a space 240 defined therein so that the circuit board 23 is located in the space 240. The lens unit 24 has a peripheral wall 245 defining two through holes 241 which are located corresponding to the two threaded holes 215 of the radiator 21 and the two side holes 220 of the mounting ring 22. The peripheral wall 245 of the lens unit 24 is fitted around the mounting ring 22 and abuts against the bottom flange 22*a* of the mounting ring 22. Bolts 242 are inserted through the two side holes 220 of the mounting ring 22, the through holes 241 of the lens unit 24 and are engaged with the threaded holes 215 of the radiator 21. The lens unit 24 has a high-beam area 243 and a low-beam area 244. At least one LED 231 is located corresponding to the high-beam area 243, and at least one LED 231 is located corresponding to the low-beam area 244.

The cooling device 3 is connected to the second side of the seat 20 and includes a housing 30, a fan 31, an external cover 32 and a seal ring 33. The housing 30 defines therein a polygonal receiving area 300. The fan 31 is located in the receiving area 300. Multiple first ventilation holes 302 are defined at the housing 30 and communicate with the receiving area 300. The external cover 32 is connected to the housing 30 to seal the receiving area 300 and has multiple second ventilation holes 322 being opposite to the first ventilation holes 302. The housing 30 of the cooling device 3 has multiple threaded holes 301 defined therein. The external cover 32 has multiple holes 320 which are located corresponding to the threaded holes 301 of the housing 30. Multiple bolts 321 are inserted through the holes 320 of the external cover 32 and are threadedly connected to the threaded holes 301 of the housing 30. The housing 30 of the cooling device 3 has a tubular member 303 extending from a portion of the housing 30 where the first ventilation holes 302 are located. The tubular member 303 is inserted in the room 203 of the tubular portion 202 of the seat 20, so that the cooling device 3 is located at a predetermined distance away from the radiating fins 216 of the radiator 21. The tubular member 303 defines a first indentation 304 and a second indentation 305 at an outer surface thereof. The second indentation 305 is adjacent to and at a right angle to the first indentation 304 and extends to the distal end of the tubular member 303. Therefore, the first and second indentations 304, 305 generally form an L-shaped engaging groove. A raised division strip 306 is located between the first and second indentations 304, 305. The tubular member 303 of the housing 30 of the cooling device 3 has a seal ring 33 mounted thereto. The housing 30 of the cooling device 3 has multiple threaded holes 301 defined therein. The external cover 32 has multiple holes 320 which are located corresponding to the threaded holes 301 of the housing 30. Multiple bolts 321 are inserted through the holes 320 of the cover 32 and are threadedly connected to the threaded holes 301 of the housing 30.

Referring to FIGS. 3 to 9, when assembling the present invention, the columns 214 are fitted into the passages 212 of the radiator 21, wherein a rear end of each column 214 is projected out of the positioning portion 210, and a front end of each column 214 is in contact with the electronic board 23. The positioning portion 210 of the radiator 21 is inserted into the recessed area 200 of the seat 20, and the rear ends of the two columns 214 are inserted into the positioning holes 201 of the seat 20. The bolts 207 are inserted through the holes 206 of the seat 20 and are threadedly connected to rear ends of the threaded holes 213 of the radiator 21 to connect the radiator 21 to the seat 20. The mounting ring 22 is mounted to the radiator 21 to align the side holes 220 with the threaded holes 215. The circuit board 23 is mounted over the radiator 21 and the mounting ring 22 such that the positioning rod 211 of the radiator 21 is inserted into the hole 230 of the circuit board 23. The holes 232 of the circuit board 23 are located corresponding to the threaded holes 213 of the radiator 21. The bolts 233 are inserted through the holes 232 of the circuit board 23 and are threadedly connected to front ends of the threaded holes 213 of the radiator 21 to connect the circuit board 23 to the radiator 21. The lens unit 24 is then connected to the radiator 21 and the mounting ring 22. The through holes 241 of the lens unit 24 are located corresponding to the two threaded holes 215 of the radiator 21 and the two side holes 220 of the mounting ring 22. The bolts 242 are inserted through the two side holes 220 of the mounting ring 22, the through holes 241 of the lens unit 24 and are connected to the threaded holes 215 of the radiator 21. The circuit board 23 is located in the space 240 of the lens 24. At least one LED 231 is located corresponding to the high-beam area 243, and at least one LED 231 is located corresponding to the low-beam area 244.

The fan 31 is located in the receiving area 300 of the housing 30 and the external cover 32 is connected to the housing 30 to seal the receiving area 300. The bolts 321 are inserted through the holes 320 of the external cover 32 to position the fan 31 in the receiving area 300 of the housing 30. The seal ring 33 is mounted to the tubular member 303 of the housing 30. The tubular member 303 is inserted in the room 203 of the tubular portion 202 of the seat 20, while the protrusion 204 is fitted with the second indentation 305. The tubular member 303 is then rotated an angle to allow the protrusion 204 to move over the raised division strip 306 to be engaged with the first indentation 304, thus connecting the tubular member 303 to the seat 20. The raised division strip 306 restricts the protrusion 204 from being disengaged from the first indentation 304. The raised division strip 360 facilitates the protrusion 204 to be retained in the first indentation 304.

As shown in FIGS. 6 to 9, when using the high beam, the LED 231 located corresponding to the high beam area 243 is activated at its rated power, and the LED 231 located corresponding to the low beam area 244 is activated at half its rated power. The light beams from the LEDs 231 are respectively reflected by the associated reflection surfaces and pass through the high beam area 243 and the low beam area 244. The range and angle of the light beams are controlled by the curvatures of the high beam area 243 and the low beam area 244.

When using the low beam, the LED 231 located corresponding to the high beam area 243 is de-activated, and the LED 231 located corresponding to the low beam area 244 is operated at its rated power. The present invention does not need additional barrier unit and convex lens. The range and angle of the light beams are controlled by the curvatures of the high beam area 243 and the low beam area 244, and thus the light beams are even, and the barrier unit can be omitted.

The fan 31 sucks cool air from the outside environment via the second ventilation holes 322 of the external cover 32, and send out the cool air out of the housing 30 via the first ventilation holes 302 to dissipate the heat conducted to the radiating fins 216 of the radiator 21. The fan 31 can also be rotated in opposite direction to suck cool air to enter the housing 30 via the first ventilation holes 302, and thus the heat conducted to the radiating fins 216 of the radiator 21 can be taken away with the air being released into the outside environment via the second ventilation holes 322 of the external cover 32.

While we have shown and described the embodiment in accordance with the present invention, it should be clear to those skilled in the art that further embodiments may be made without departing from the scope of the present invention.

What is claimed is:

1. A headlight system comprising:

a seat having a first side and a second side;

a radiator having a front portion and a rear portion and defining therein two passages, wherein the rear portion is formed integrally with multiple radiating fins at an outer periphery thereof and is connected to the first side of the seat;

a mounting ring being fitted around the front portion of the radiator, the mounting ring having a bottom flange;

a circuit board mounted on an end surface of the front portion of the radiator and the mounting ring, the circuit board having at least two Light Emitting Diodes (LEDs);

two columns being fitted into the two passages of the radiator and in contact with the circuit board;

a lens unit mounted over the front portion of the radiator and the mounting ring, the lens unit having a space defined therein, the circuit board located in the space, the lens unit having a high-beam area and a low-beam area, wherein at least one LED is located corresponding to the high-beam area, and at least one LED is located corresponding to the low-beam area, and the lens unit has a peripheral wall being fitted around the mounting ring and abutting against the bottom flange of the mounting ring; and a cooling device connected to the second side of the seat, the cooling device including a housing, a fan, and an external cover, the housing defining therein a receiving area and defining multiple first ventilation holes communicating with the receiving area, the fan mounted in the receiving area of the housing, the external cover defining multiple second ventilation holes opposite to the first ventilation holes and capable of sealing the receiving area of the housing, the first ventilation holes being located at a predetermined distance away from the radiating fins of the radiator, so that the radiating fins can be cooled down effectively by an air current generated by the fan inside the housing of the cooling device.

2. The headlight system as claimed in claim 1, wherein the front portion of the radiator further defines a threaded hole at a periphery thereof, the mounting ring defines a side hole corresponding to the threaded hole of the front portion of the radiator, the peripheral wall of the lens unit defines a through hole corresponding to the threaded hole of the radiator, and a bolt is inserted through the through hole of the lens unit, the side hole of the mounting ring to be engaged with the threaded hole of the front portion of the radiator.

* * * * *